US007171887B2

(12) United States Patent
Lilla

(10) Patent No.: US 7,171,887 B2
(45) Date of Patent: Feb. 6, 2007

(54) REGULATING DEVICE FOR HYDROSTATIC PISTON MACHINES

(75) Inventor: Winfried Lilla, Neu-Ulm (DE)

(73) Assignee: Brueninghaus Hydromatik GmbH, Elchingen (DE)

( * ) Notice: Subject to any disclaimer, the term of this patent is extended or adjusted under 35 U.S.C. 154(b) by 15 days.

(21) Appl. No.: 10/514,548

(22) PCT Filed: Apr. 11, 2003

(86) PCT No.: PCT/EP03/03793

§ 371 (c)(1),
(2), (4) Date: Jul. 14, 2005

(87) PCT Pub. No.: WO03/095831

PCT Pub. Date: Nov. 20, 2003

(65) Prior Publication Data

US 2005/0252369 A1 Nov. 17, 2005

(30) Foreign Application Priority Data

May 10, 2002 (DE) ..... 102 20 889

(51) Int. Cl.
*F04B 49/00* (2006.01)
*F04B 1/32* (2006.01)
*F03C 1/24* (2006.01)

(52) U.S. Cl. ..... 91/387; 60/426

(58) Field of Classification Search ..... 60/426; 91/365, 387

See application file for complete search history.

(56) References Cited

U.S. PATENT DOCUMENTS 3,817,033 A 6/1974 Appel et al.
4,559,778 A * 12/1985 Krusche ..... 60/447
4,599,050 A * 7/1986 Ishizaki et al. ..... 417/216
4,722,186 A 2/1988 Louis et al.
4,756,157 A * 7/1988 Appel ..... 60/444
5,160,245 A * 11/1992 Geringer ..... 60/445
6,283,721 B1 9/2001 Gollner

FOREIGN PATENT DOCUMENTS

DE 3404534 9/1985
DE 198 42 029 3/2000

OTHER PUBLICATIONS

German Technical Description, Linde Hydraulik, issued 1984, pp. 1-17.
German Data Publication, Linde Hydraulik, issued Apr. 2000, pp. 1-20.

* cited by examiner

*Primary Examiner*—Thomas E. Lazo
(74) *Attorney, Agent, or Firm*—Scully, Scott, Murphy & Presser, P.C.

(57) ABSTRACT

The invention relates to a regulating device for hydrostatic piston machines consisting of an actuating piston (2) which can be removed between two end positions which can be impinged upon by actuating pressure exerted thereon in an opposite direction. An actuating pressure regulating valve (5) is used to regulate the actuating pressure. The actuating regulating valve (5), which is used to regulate the actuating pressure, comprises a regulating piston which can be shifted from a neutral position and which can be impinged upon with a regulating force which is dependent on the position of the actuating piston (2). The regulating force is directed counter to a control force acting upon the regulating piston (6) and the regulating force is zero when the regulating device (1) is in a rest position. When the regulating device (1) is in a rest position, the regulating piston (6) is in a neutral position and the actuating piston (2) is a specific end position.

14 Claims, 2 Drawing Sheets

REGULATING DEVICE FOR HYDROSTATIC PISTON MACHINES

The invention relates to an adjusting device for hydrostatic piston machines, in particular hydraulic motors of travel drives.

An adjusting device in which a pivoting angle of a hydrostatic piston machine can be set by a setting piston movement, the setting movement of the setting piston being fed back to a regulating valve, is known from DE 195 40 654 C1. The feedback of the setting movement of the setting piston makes it possible to set a pivoting angle which is proportional to a controlled variable. A respective setting pressure, which is set by a regulating valve, acts on the two oppositely oriented piston surfaces of the setting piston in the setting pressure chamber. In dependence on an axial position of a regulating piston, the two setting pressure chambers are subjected to a corresponding setting pressure. The regulating piston can be subjected to a respective control pressure at its two end faces to displace it from its central position.

A force proportional to the displacements of the setting piston from its central position can be fed back to the regulating piston via a setting lever and two legs coupled to a spring. The feedback takes place in such a way that there is exerted on the regulating piston a force which is directed opposite the control pressure present at a respective end of the regulating piston.

In the case of the setting device described, it is disadvantageous that, during a movement stroke of the setting piston from one end position to the other end position, it has to cross the central position, in which case the feedback is transferred from one leg to the other leg. Since a play-free design of the setting lever, of the two legs and of the corresponding drivers is not possible, this inevitably leads to an unharmonious adjustment of the pivoting angle.

The object of the invention is to provide an adjusting device having harmonious adjustment of the pivoting angle over the entire pivoting angle range.

The object is achieved by the adjusting device according to the invention having the features of claim 1 or claim 3.

According to the invention, in the rest position of the adjusting device according to claim 1, the setting piston is in a given end position, while the regulating piston of the regulating valve is in its neutral position. In this rest position, the regulating piston is free from forces. Since a displacement of the setting piston from its end position is possible in one direction only, over the entire movement stroke up to its second end position the regulating piston is only subjected to a regulating force oriented in one direction as well. Since there is no change of direction of the regulating force on the regulating piston, the unharmonious adjustment of the pivoting angle in the region of the central position is prevented.

Alternatively, according to claim 3, the return force may also be non-zero in the central rest position of the adjusting device. In this case, the regulating piston in the central rest position is not in its neutral position if there is no control force transmitted to the regulating piston.

Advantageous developments of the invention are possible through the measures given in the subclaims.

Exemplary embodiments of the invention are illustrated in the drawings and explained in more detail in the following description. In the drawings.

Figure 1:
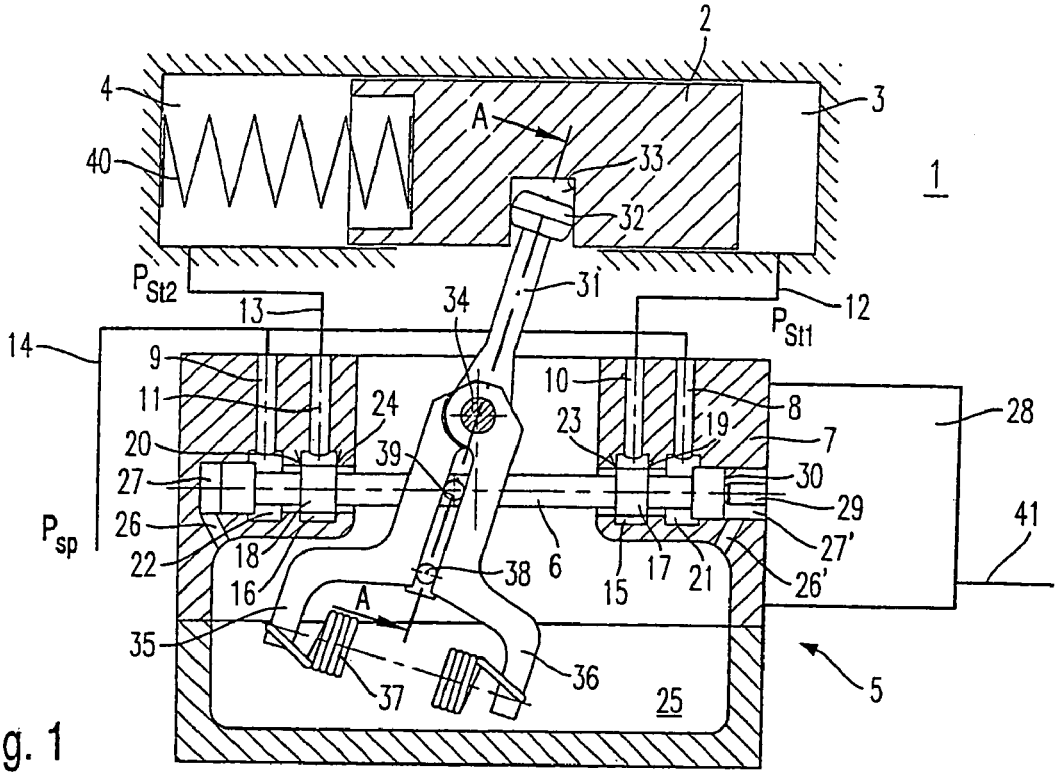
FIG. 1 shows a schematic illustration of a first exemplary embodiment of the adjusting device according to the invention in the rest position.

In FIG. 1, a first exemplary embodiment of an adjusting device 1 according to the invention is illustrated. To regulate a pivoting angle of a hydrostatic piston machine (not illustrated), a setting piston 2 in a setting pressure chamber 3 and a second setting pressure chamber 4 is subjected to a setting pressure. The setting pressures acting in the first and second setting pressure chamber 3 and 4 act on the oppositely oriented piston surfaces of the setting piston 2, and if there is a pressure difference a resultant force acts on said piston. To set the pressure difference in the two setting pressure chambers 3 and 4, a setting pressure regulating valve 5 is provided. The setting pressure regulating valve 5 has a regulating piston 6, which is arranged axially displaceably in a bore of a housing 7. Furthermore, a first feed pressure bore 8 and a second feed pressure bore 9 are formed in the housing 7. The first feed pressure bore 8 and second feed pressure bore 9 are connected to a feed pressure line 14, which can be connected, for example, to an auxiliary pressure source.

To set the setting pressures in the first setting pressure chamber 3 and the second setting pressure chamber 4, the feed pressure line 14, and the first feed pressure bore 8 or the second feed pressure bore 9, can be connected to a first setting pressure line 12 or a second setting pressure line 13. For this purpose, the first setting pressure line 12 is connected to a first setting pressure channel 10, which opens into a first groove 15 on the side of the regulating piston 6. Likewise, the second setting pressure line 13 is connected to a second groove 16 via a second setting pressure channel 11. In the region of the first groove 15 and second groove 16, the regulating piston 6 has a first regulating piston section 17 and a second regulating piston section 18, respectively. The two regulating piston sections 17 and 18 have a first setting pressure control edge 19 and a second setting pressure control edge 20, respectively, which edges are arranged at the oppositely oriented ends of the respective regulating piston section 17 and 18. The first setting pressure control edge 19 and the second setting pressure control edge 20 form, with the respective first groove 15 and second groove 16, a throttling point which is variable in dependence on the axial position of the regulating piston 6. Through the joint movement of the two control edges 19 and 20 here, in each case one throttle is opened and simultaneously the other throttle is closed.

Depending on the direction of movement of the regulating piston 6, the first setting pressure channel 10 is thus connected to a first feed pressure groove 21 via the first groove 15, and the first setting pressure chamber 3 is thus pressurised with the pressure from the feed pressure line 14. Analogously, the second setting pressure channel 11 is connected to a second feed pressure groove 22 via the second groove 16 when the regulating piston 6 is displaced in the opposite direction.

On that side of the first regulating piston section 17 which faces away from the first setting pressure control edge 19, a first pressure-relief control edge 23 is arranged. Likewise, a second pressure-relief control edge 24 is arranged on the second regulating piston section 18. In dependence on the axial position of the regulating piston 6, via the two pressure-relief control edges 23 and 24 the respective setting pressure chambers 3 and 4 are relieved of pressure into a tank volume 25 via the first groove 15 and the second groove 16, respectively.

Also connected to the tank volume 25, via the volume-compensating channels 26 and 26', are the rear regulating piston spaces 27 and 27'. The slight volume fluctuations which arise in the rear regulating piston spaces 27 and 27' due to an axial movement of the regulating piston 6 are thus compensated. In addition, some of the regulating piston leakage is discharged into the tank volume 25 via the volume-compensating channels 26 and 26'.

Figure 2:
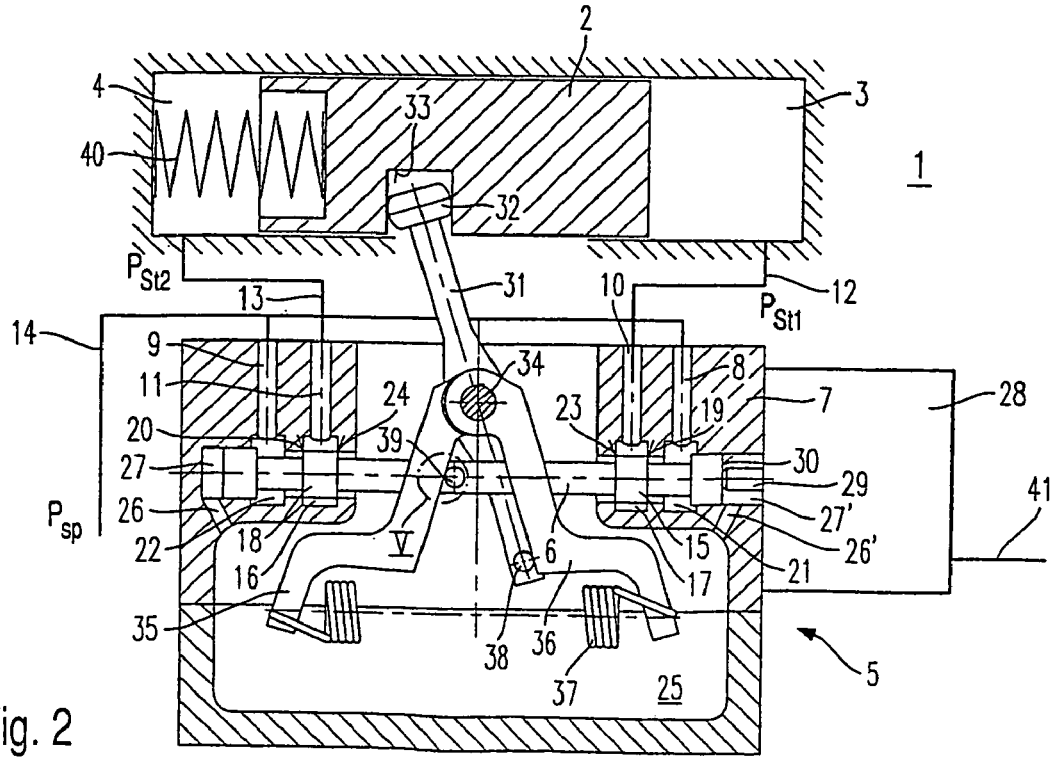
FIG. 2 shows a schematic illustration of the first exemplary embodiment of the adjusting device according to the invention in its second end position.

In order to displace the setting piston 2 into its second end position, illustrated in FIG. 2, a proportional magnet 28 is provided, which is arranged on the housing 7 of the regulating valve 5. The proportional magnet 28 has a tappet 29, the tappet 29 acting on an end face 30 of the regulating piston 6. A control force can thus be transmitted to the regulating piston 6 in the axial direction, which is produced by the proportional magnet 28 in dependence on a control signal supplied to the proportional magnet 28 via an electrical connection 41. If such a control signal is supplied to the proportional magnet 28 via the electrical connection 41, said magnet produces a force which displaces the regulating piston 6. In this case, due to the axial movement of the regulating piston 6, a gap allowing a through-flow is produced at the first setting pressure control edge 19. The pressure medium supplied via the feed pressure line 14 and the first feed pressure bore 8 can pass into the first setting pressure chamber 3 via the first setting pressure channel 10. The pressure, which is thus increased in the first setting pressure chamber 3, causes a displacement of the setting piston 2 in the direction of its second end position, counter to the force of a restoring spring 40. Simultaneously with the opening of the throttling point at the first setting pressure control edge 19, the throttling point of the second pressure-relief control edge 24 in the second regulating piston section 18 is opened. The second setting pressure space 4 is relieved of pressure into the tank volume 25 via the second setting pressure line 13 and the second setting pressure channel 11.

For feedback of the setting movement of the setting piston 2, a driving recess 33 is provided in the setting piston 2, in which recess there is arranged a driving head 32 which is connected to the setting lever 31. The setting lever 31 is rotatably mounted on a bearing bolt 34, so that the setting movement of the setting piston 2 leads to a rotation of the setting lever 31. Also rotatably mounted on the bearing bolt 34 are a first leg 35 and a second leg 36. The first leg 35 and the second leg 36 are connected to each other via a tension spring 37, so that a displacement of one of the two legs relative to the other leads to a tensioning of the tension spring 37.

Arranged at that end of the setting lever 31 which is opposite the driving head 32 of the setting lever 31 is a driving pin 38. In the event of a movement of the setting piston 2 and an associated rotary movement of the setting lever 31, the driving pin 38 moves oppositely to the setting piston movement. The driving pin 38 bears against the second leg 36, so that due to the rotary movement of the setting lever 31 the second leg 36 is displaced relative to the first leg 35 and the spring 37 is tensioned.

In FIG. 2, the setting piston 2 is shown in its second end position, in which, as described, the second leg 36 has been displaced relative to the first leg 35, so that the tension spring 37 is at maximum tension. Due to the tension of the tension spring, a force is produced on the first leg 35, whereby the first leg 35 tries to follow the movement of the second leg 36. However, the first leg 35 is in contact with a bearing pin 39 arranged on the regulating piston 6. As a result, the force of the tension spring 37 is transmitted by the first leg 35 to the bearing pin 39, and the regulating piston 6 experiences a return force directed opposite the control force of the proportional magnet 28.

The return force is greater, the further the setting piston 2 is displaced in the direction of its second end position. The return force, transmitted by the first leg 35 to the regulating piston 6 by means of the bearing pin 39, moves the regulating piston 6 counter to the control force produced by the proportional magnet 28 until an equilibrium of forces, consisting of the return force and the control force, is achieved. When an equilibrium of forces has been established at the regulating piston 6, the regulating piston 6 is again situated in its neutral position, in which the throttles formed at the setting pressure control edges 19 and 20 are closed.

In order to produce a restoring movement of the setting piston 2 in the direction of its first end position, the displacing control signal supplied to the proportional magnet 28 via the electrical connection 41 is cancelled. The regulating piston 6 is no longer in a state of equilibrium of forces and is displaced towards the right in the illustration of FIG. 2 due to the predominant return force. In contrast to the above-described setting operation of the setting piston 2 in the direction of its second end position, a gap allowing a through-flow is now produced at the second setting pressure control edge 20 and a gap likewise allowing a through-flow is accordingly produced at the first pressure-relief control edge 23. Consequently, in the reverse situation to the setting movement, the second control pressure chamber 4 is now pressurised with the pressure medium from the feed pressure line 14, while the first control pressure chamber 3 is relieved of pressure. The setting piston 2 follows the changed pressure circumstances and moves in the direction of its first end position.

By selecting the rest position of the setting piston 2 in its first end position on disappearance of the control force, a regulating force acting in one direction is produced on the regulating piston 6 over the entire regulating range or the setting range of the setting piston 2. The regulating piston 6 is free from a regulating force only when the setting piston 2 is in its first end position. A transfer, and an associated change of direction, of the force between the two legs 35 and 36 is not necessary, so that the regulating characteristic is harmonious. The regulating force, which is proportional to the displacement of the setting piston 2, in this case likewise produces a movement of the setting piston 2 which is proportional to the control signal applied to the proportional magnet 28.

Owing to the asymmetric design, it is furthermore possible to operate the proportional magnet 28 in its proportional regulating range over the entire adjusting stroke of the setting piston 2. When two proportional magnets acting on the opposite ends of the regulating piston 6 are used, they cause irregularities in the characteristic due to the ramp up which the proportional magnet has to be brought from its currentless initial state in its proportional regulating range.

Figure 3:
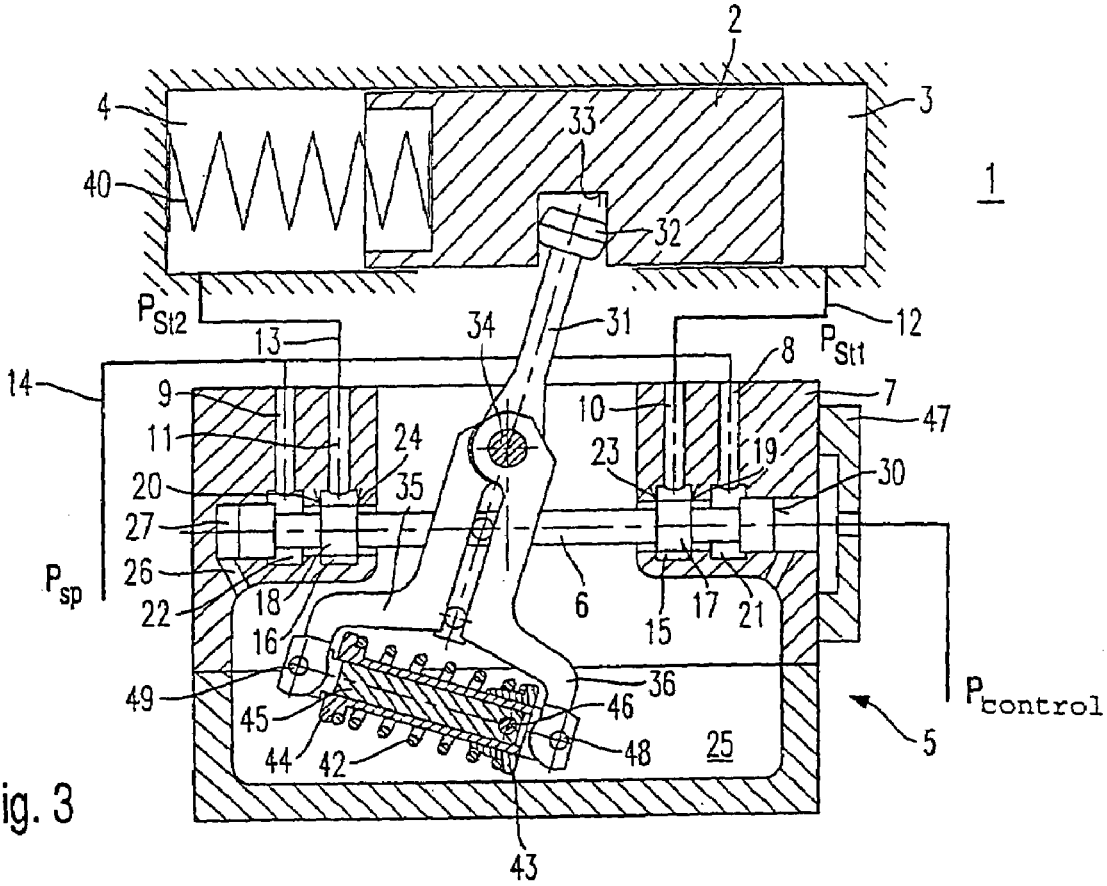
FIG. 3 shows a second exemplary embodiment of the adjusting device according to the invention in the rest position.

In FIG. 3, a second exemplary embodiment of the adjusting device according to the invention is illustrated. Instead of the tension spring 37, the force is exerted here by a compression spring 42 supported between a first spring bearing 43 and a second spring bearing 44. The second spring bearing 44 is part of a sleeve which is displaceably arranged on a sliding cylinder 45. The spring bearing 44 is rotatably connected to the second leg 36 at an eye 48 of the leg 36. The first spring bearing 43 is connected to the sliding cylinder 45 via a holding pin 46. In the sleeve region of the second spring bearing 44 there are provided slots (not illustrated) in which the holding pin 46 can execute a longitudinal displacement, so that the first spring bearing 44 is longitudinally displaceable on the outside of the sleeve. The sliding cylinder 45 is likewise rotatably mounted at an eye 49 of the first leg 35. A relative displacement of the second leg 36 with respect to the first leg 35 thus leads to a compression of the compression spring 42. The functioning of such an arrangement differs from the mode of operation explained with regard to FIG. 2 only in that the return force is produced by a compression of the compression spring 42.

Furthermore, in the exemplary embodiment shown in FIG. 3, a control pressure connection 47 is provided instead of the proportional magnet 28. A control force is exerted on the end face 30 of the regulating piston 6 via the control pressure connection 47, the control force being produced in a known manner, for example from an auxiliary pressure source.

Figure 4:
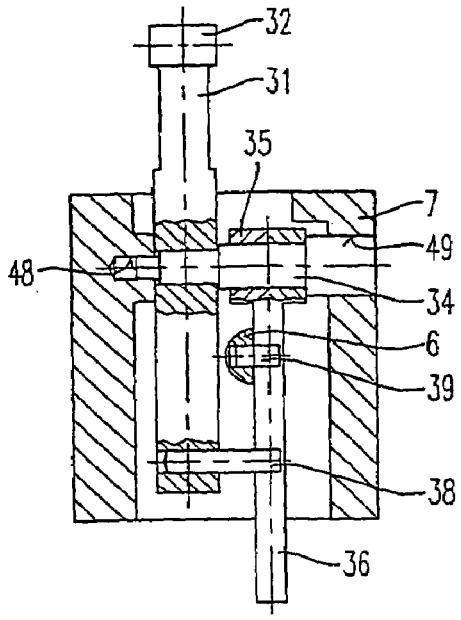
FIG. 4 shows a partial section along the line A—A of FIG. 1.

In FIG. 4, a partial section along the line A—A of FIG. 1 is illustrated. The setting lever 31, the leg 35 and the second leg 36 are rotatably mounted on a common bearing bolt 34. The bearing bolt 34 is of multi-step design, and is fixed in the housing 7 in a first bore 48 and a second bore 49. At that end of the setting lever 31 which faces away from the driving head 32, the driving pin 38 is arranged in a bore. The bearing pin 39 is likewise arranged in a bore in the regulating piston 6. The driving pin 38 and the bearing pin 39 are fixed with a press fit in their bores. As already described, the driving pin 38 acts on the second leg 36, while the bearing pin 39 acts on the first leg 35, which in FIG. 4 is only illustrated in the region of the bearing bolt 34 owing to the position of the section line. As can be seen in FIG. 4 by the illustration of the first leg 35 and the second leg 36 in the region of the bearing bolt 34, the legs 35 and 36 are flattened in the axial direction in the region of mounting on the bearing bolt 34.

Figure 5:
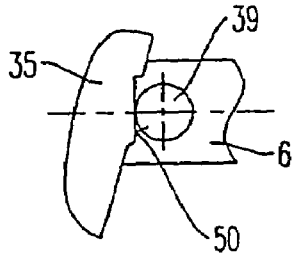
FIG. 5 shows an enlarged illustration of the detail V of FIG. 2.

In FIG. 5, an enlarged view of the detail V of FIG. 1 is illustrated. The detail shows part of the first leg 35 and of the regulating piston 6 with the bearing pin 39 arranged therein. In the region of the bearing pin 39, the first leg 35 has a flattened area 50. The flattened area 50 is oriented such that the longitudinal axis of the regulating piston 6 encloses a right angle with the flattened area 50. This prevents the application of the return force to the regulating piston 6 from deviating from the latter's centre axis and hence its direction of movement. The right-angled arrangement illustrated, between the flattened area 50 and the axis of the regulating piston 6, applies exactly only in the rest position of the adjusting device 1, in which the regulating piston is in its neutral position and the setting piston 2 is in its first end position. The adjusting strokes of the regulating piston 6 are, however, small, so that the right angle is approximately maintained.

Alternatively, the return force may also be non-zero in the rest position, which is then central, of the adjusting device 1, even if the feed pressure $p_{sp}$ is zero. The central rest position is then ensured by two compression springs 40 arranged on respective sides of the regulating piston 2, as in DE 195 40 654 C1. In this case, in the central rest position, the regulating piston 6 is then not in its neutral position if there is no control force transmitted to the regulating piston 6 by the proportional magnet 28 or by the control pressure $p_{control}$.

The invention claimed is:

1. Adjusting device for hydrostatic piston machines having a setting piston, which is movable between two end positions and which can be subjected to setting pressures acting oppositely on it, and a setting pressure regulating valve, by which the setting pressures can be regulated, the setting pressure regulating valve having a regulating piston, which can be displaced from a neutral position and is subjected to a return force dependent on the position of the setting piston and directed opposite a control force acting on the regulating piston, the return force being zero in a rest position of the adjusting device, wherein in the rest position the regulating piston is in its neutral position and the setting piston is in a given end position.

2. Adjusting device according to claim 1, wherein the regulating piston can be subjected to a control force on one side.

3. Adjusting device for hydrostatic piston machines having a setting piston, which is movable between two end positions and which can be subjected to setting pressures acting oppositely on it, and a setting pressure regulating valve, by which the setting pressures can be regulated, the setting pressure regulating valve having a regulating piston, which can be displaced from a neutral position and is subjected to a return force dependent on the position of the setting piston and directed opposite a control force acting on the regulating piston, the return force being non-zero in a central rest position of the adjusting device, wherein in the central rest position the regulating piston is not in its neutral position if there is no control force transmitted to the regulating piston.

4. Adjusting device according to claim 2 or 3, wherein a proportional magnet is provided to produce the control force.

5. Adjusting device according to claim 3, wherein an end face of the regulating piston can be subjected to a control pressure ($p_{control}$) to produce the control force.

6. Adjusting device according to claims 1 or 3, wherein the return force can be transmitted to the regulating piston by a first leg via a bearing pin.

7. Adjusting device according to claim 6 wherein the return force is proportional to the tension of a spring arraigned between the first leg and a second leg operatively connected to the first leg via the spring.

8. Adjusting device according to claim 7, wherein the second leg is displaceable relative to the first leg and the displacement is dependent on the position of the setting piston.

9. Adjusting device according to claim 8, wherein the second leg is displaceable by a driving pin arranged on a setting lever, and the setting lever is coupled to the setting piston for feedback of the position.

10. Adjusting device according to claim 9, wherein the first leg, the second leg and the setting lever have a common pivot.

11. Adjusting device according to claim 7, wherein the spring arranged between the first and the second leg is a tension spring.

12. Adjusting device according to claim 7, wherein the spring arranged between the first and the second leg is a compression spring supported on two spring bearings, in each case one spring bearing being connected to the first and the second leg, respectively, and in that, on displacement of the second leg relative to the first leg, the compression spring counteracts the displacement.

13. Adjusting device according to claim 6, wherein the first leg has a bearing surface for the bearing pin, the surface normal of which bearing surface is oriented parallel to the direction of movement of the bearing pin in the rest position of the adjusting device.

14. Adjusting device according to claims 1 or 3, wherein the regulating piston has, for each setting pressure chamber, a regulating piston section with in each case two control edges, via which the respective setting pressure chamber can be connected to a feed pressure source or a tank volume.

* * * * *